US008020349B2

(12) United States Patent
Chelak

(10) Patent No.: US 8,020,349 B2
(45) Date of Patent: Sep. 20, 2011

(54) MULTI-FORM SILO STORAGE SYSTEM

(76) Inventor: Yaroslaw Steve Chelak, Morristown, NJ (US)

( * ) Notice: Subject to any disclaimer, the term of this patent is extended or adjusted under 35 U.S.C. 154(b) by 480 days.

(21) Appl. No.: 11/323,708

(22) Filed: Dec. 29, 2005

(65) Prior Publication Data

US 2007/0151168 A1 Jul. 5, 2007

(51) Int. Cl.
*E04H 7/00* (2006.01)

(52) U.S. Cl. ..... 52/194; 150/154; D34/39; 428/18; 428/99

(58) Field of Classification Search ..... 52/192, 52/194, 223.3; 150/154–168; D34/4, 39; 428/15–27, 99
See application file for complete search history.

(56) References Cited

U.S. PATENT DOCUMENTS

| | | | | | |
|---|---|---|---|---|---|
| 2,365,086 | A | * | 12/1944 | Kamowski | 220/694.1 |
| 3,263,854 | A | | 8/1966 | Powers | |
| 3,428,245 | A | | 2/1969 | Burdett | |
| 3,870,391 | A | * | 3/1975 | Nims | 312/297 |
| 4,249,679 | A | * | 2/1981 | Dillman | 222/542 |
| 4,503,646 | A | | 3/1985 | Lowe | |
| D347,480 | S | | 5/1994 | Deere et al. | |
| 5,426,900 | A | | 6/1995 | Springer | |
| 5,448,867 | A | | 9/1995 | Wilson | |
| 5,570,547 | A | * | 11/1996 | Webb et al. | 52/194 |
| 6,035,919 | A | * | 3/2000 | Zinbarg | 160/113 |
| 6,123,187 | A | | 9/2000 | Bartels | |
| 6,286,266 | B1 | * | 9/2001 | Popowych et al. | 52/40 |
| 6,851,228 | B1 | | 2/2005 | Forman | |
| 7,117,908 | B1 | | 10/2006 | Coron | |
| 2002/0189730 | A1 | | 12/2002 | Garofalo et al. | |

FOREIGN PATENT DOCUMENTS

GB 2334328 A 8/1999

OTHER PUBLICATIONS

European Search Report issued on Jan. 29, 2010 from European Patent Application No. 06840289.0.
PCT Search Report and Written Opinion issued on Jul. 7, 2008 from PCT Patent Application No. PCT/US2006/062191.

* cited by examiner

*Primary Examiner* — William V Gilbert
(74) *Attorney, Agent, or Firm* — Walter G. Hanchuk; Chadbourne & Parke LLP

(57) ABSTRACT

A silo storage unit is created to enable an owner to conveniently store and dispense any number of materials. In one implementation, the storage silo is configured to store and dispense a heating fuel material. The silo storage unit may be implemented as a temporary installation or a year-round installation. Also, the silo storage unit includes a storage chamber configured with at least one outlet aperture, an inlet aperture. The storage chamber is formed with at least one attachment point configured to secure a facade cover to the silo storage unit. The facade cover may be formed from a cloth material, plastic material or any other number of materials. Further the facade cover may be configured as a holiday implementation, a housing element implementation, or a non-intrusive implementation. In the non-intrusive implementation, the facade cover may be configured to with artificial branches or leaves.

11 Claims, 8 Drawing Sheets

MULTI-FORM SILO STORAGE SYSTEM

FIELD OF THE INVENTION

The invention is directed to an improved container for storing and dispensing materials. More specifically, the invention is configured to provide a convenient non-intrusive storage facility that provides easy access to the stored material, while facilitating a user determined aesthetically pleasing shape or appearance.

BACKGROUND OF THE INVENTION

Storage units have conventionally been configured to facilitate storage needs without necessarily adapting the storage unit to complement the location in which it is situated. For example, certain storage units have been configured to maximize storage capabilities or to create convenient loading/dispensing points. However, generally, storage units are not configured specifically to minimize visual impact and complement a specific dispensing environment.

Further, there has been a significant shift in the use of alternative fuel sources. One primary issue impeding the broad adoption of alternative fuel sources, such as bio mass fuels (e.g., corn kernel—a common biomass fuel used with specialty heating stoves and furnaces) relates to storage concerns associated with the product. Bio fuel is typically a solid pellet or granular material. However, in order to expedite adoption of the alternate fuel source it would be advantageous to have a convenient non-intrusive storage/distribution system and apparatus.

SUMMARY OF THE INVENTION

Accordingly, it is an object of the invention to create a convenient non-intrusive storage/distribution system and apparatus. The invention may be adapted and configured to facilitate a broad range of actual implementations to meet the specific needs of a consumer. By way of example only, the storage unit may be adapted for implementations within the interior of a home or an outdoor location.

Furthermore, the storage unit may be configured for either permanent embodiments or temporary embodiments. For example, a permanent embodiment might involve a home owner purchasing a storage container and entering into a service contract where a fuel material supplier re-fills the container when the storage levels drop to predetermined points. Alternately, an example of a temporary installation might include a fuel material supplier leasing one or more containers to a home owner for a season.

In the temporary implementation, the supplier selects a container that when filled is large enough to meet the home owner's needs for an entire season. Further, in the temporary implementation, the supplier fills the container once initially, delivers the container to the home owner's property and then collects the empty container at the end of the season (It is to be understood that this implementation is not limited to a single initial fuel supply and the parties may negotiate for the supplier to deliver additional fuel (and/or containers) to the home owner, should the need arise during the season).

It is an objective of the present invention to implement a storage unit that is adaptable to and easily configurable for a wide variety of non-intrusive implementations. Depending on the implementation, the storage unit may be configured so that a storage unit owner can manually adapt the storage unit to complement the unit's particular surroundings. For example, the owner of a storage unit's may configure the storage unit to complement its surrounds through a number of different options based on the particular unit's characteristics, as well as the unit's location. In one embodiment where the user can change the configuration of the unit's exterior surface, the storage unit is adapted with attachment points for securing an adaptive cover to the storage unit. Alternately, in a non-adaptable embodiment, the storage owner selects a particular storage unit with a static exterior surface. An example of a non-adaptable embodiment is a storage unit formed with a plastic hardened shell that is formed as a static decorative facade.

An embodiment of the invention is directed to a silo storage unit that is configured to dispense heating fuel materials. Accordingly, the silo may be situated within the interior of the house or along the exterior of the house. The silo is configured with an input receptacle for loading the silo, as well as a dispensing component for dispensing the material stored in the silo. Depending on the actual implementation, the silo may be configured to store and dispense liquid or solid fuel materials. Moreover, the silo storage unit may be adapted to complement the surrounding area, wherever it is situated.

DETAILED DESCRIPTION OF THE INVENTION

The invention is directed to a storage unit that is configured and adapted to store and dispense a storage material, while also complementing the environment surrounding the storage unit. For illustrative purposes only, a heating-fuel material dispensing silo storage unit is described herein. However, it is to be understood, that the invention may be implemented in any number of shapes, sizes depending on the particular requirements of the application and adapted to store and dispense solids or liquids or any other number of substances. For example, the invention may be adapted for any number of materials, such as livestock feed, heating oil, and/or road salt/sand for ice prevention. As will be described, the storage silos may be configured in a broad variety of implementations.

Advantageously, the broad variety of implementations facilitates a great deal of flexibility regarding where an owner can place the storage unit. For example, the storage silo may be configured for either interior or external home storage implementations. Further, based on the particular application, the storage silo may be configured for a short term or long term deployment. The silo may be stored at a certain location for a season, a month or any other relatively short period of time. Alternately, certain embodiments of the invention are directed to long term (year-round) implementations, that are permanent or include periods of time longer than a season.

Figure 1A:
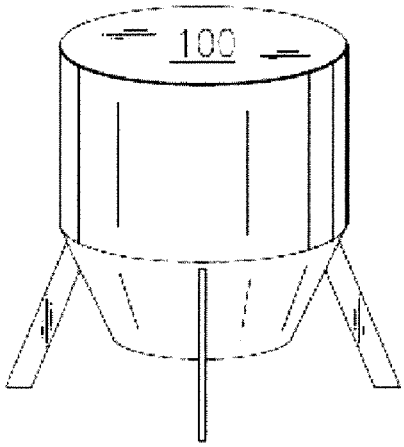
FIGS. 1A-1C illustrates perspective views of storage chambers associated with various embodiments of the invention.
Figure 1B:
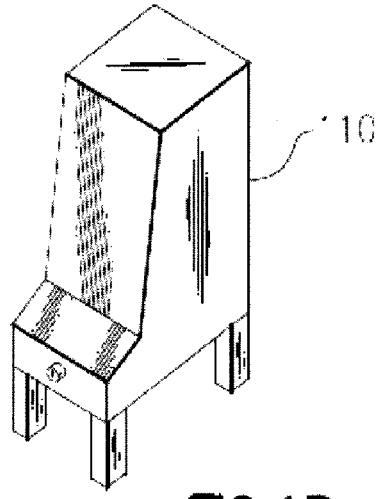
Figure 1C:
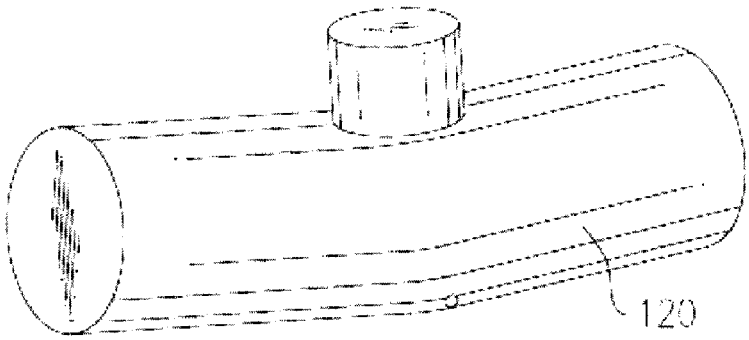

FIGS. 1A-1C illustrate implementations of the storage chamber associated with the storage unit. By way of example only, the storage chamber may be configured based on the requirements of a particular implementation. For example, the shape and size of the storage unit may vary. FIGS. 1A-1C illustrate three storage chambers 100, 110 and 120. It is to be understood that the actual size and shape of the storage chamber is determined based on a range of considerations some of which include: the type of storage material, the space constraints for placement of the storage unit and other issues. Although other materials can be stored within these units, the invention will be described in the context of the embodiment illustrated in FIG. 1A directed to a silo configured to store and dispense a solid high-energy fuel material, such as corn, or other heating-fuel pellet material.

The location where the storage unit will be disposed is a critical factor as an owner determines the physical implementation of the storage unit to best serve the owner's needs. For example, an owner in sparsely populated or rural areas may decide on getting a larger storage unit with a greater storage capacity. In contrast, in areas where access to refill provisions is readily available and space is at a premium, an owner may balance obtaining a smaller storage unit with the possible need to fill a smaller storage unit frequently.

In yet another embodiment of the invention, the storage unit is configured as a temporary unit. Temporary storage units may be filled by a fuel material distributor and leased or rented by a home owner. Advantageously, the temporary storage unit may be filled at the beginning of the season with enough fuel material to last for an entire season. At the end of the season, the supplier removes the empty silo storage unit from the home owner's property. Alternately, a home owner may purchase a permanent installation and enter into a services contract with a storage material supplier who will re-fill the storage unit as needed.

Furthermore, based on the storage material, the storage unit may be customized with environmental protection and/or control mechanisms. It is to be understood that based on the type of storage material in a particular implementation, the storage unit may be configured with a humidity regulator, an auger-based delivery control mechanism and/or additional outlets configured for manually dispensing stored material. The storage unit may also be adapted with rodent, insect and/or pest prevention mechanisms.

Figure 2A:
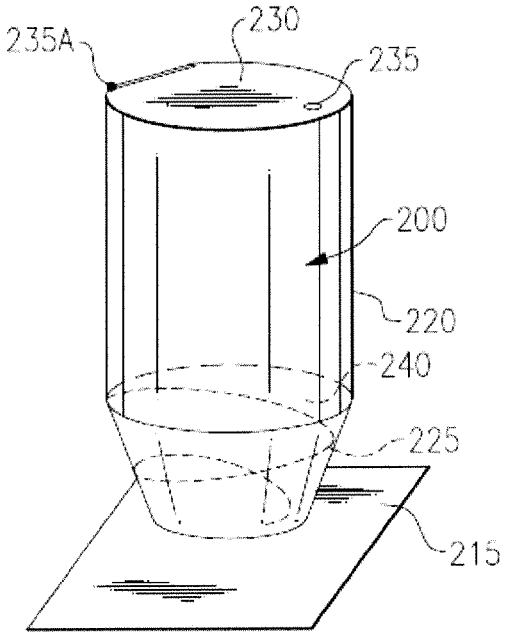
FIG. 2A illustrates a perspective view of the storage chamber associated with the storage unit illustrated in FIG. 1A, in addition to an auger surface situated at the dispensing end of the storage unit.

FIG. 2A is a perspective view of a storage chamber configured as a vertical axis silo storage unit 200. As illustrated, vertical axis storage silos 200 maximize the storage capacity, while minimize the storage unit footprint 215. In order to facilitate dispensing the stored fuel material, the vertical axis silo is formed as a vertical cylindrical portion 220 with a conical dispensing portion 225 situated at the bottom of the cylinder. The top end 230 of the storage unit is configured with an attachment point 235 for a hose used to fill the storage tank. Alternately, the top end 230 of the storage unit may include a cover that is pivotally attached at point 235A.

Figure 2B:
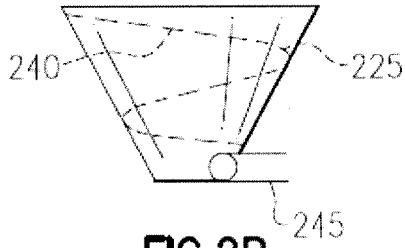
FIG. 2B illustrates a side view of the dispensing portion of the storage unit illustrated in FIG. 2A.

FIG. 2B illustrates a side view of the conical dispensing portion 225 of the vertical-axis silo 200. The interior surface of the conical portion is configured with an auger surface 240 that assists in dispensing solid fuel materials from the storage unit through delivery hose/chute 245. More specifically, a flexible plastic hose or other type of conveying tube 245 is attached to the narrow end of the conical portion 245. The stored material may be pumped or gravity-fed into the delivery tube 245. The other end of the delivery tube 245 may be attached to a heating unit, such as an oil or solid pellet burning stove.

As discussed above, the storage unit 200 is configured so that the exterior surface may be customized by an owner. The storage unit owner may configure the exteriors of the storage unit 200 with a wide variety options depending on whether the storage unit is a temporary/permanent, interior/exterior implementations, as well as their personal tastes. For example, the owner may decide whether the exterior should be configured with a decorative, non-intrusive or functional facade.

Figure 3C:
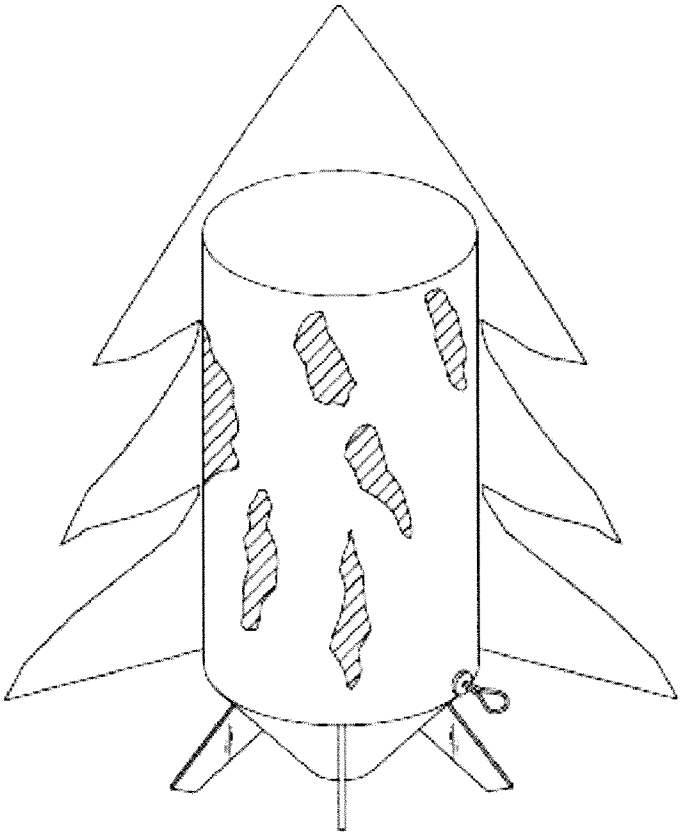
FIGS. 3A-3C illustrate embodiments of the invention that are situated within the interior of a home.
Figure 3B:
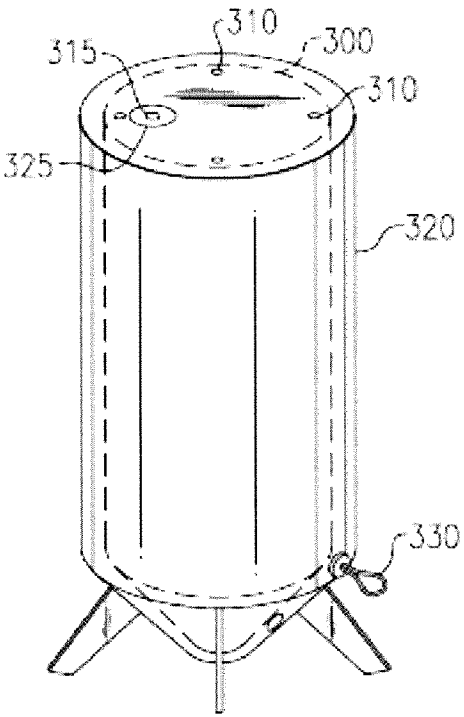
Figure 3A:
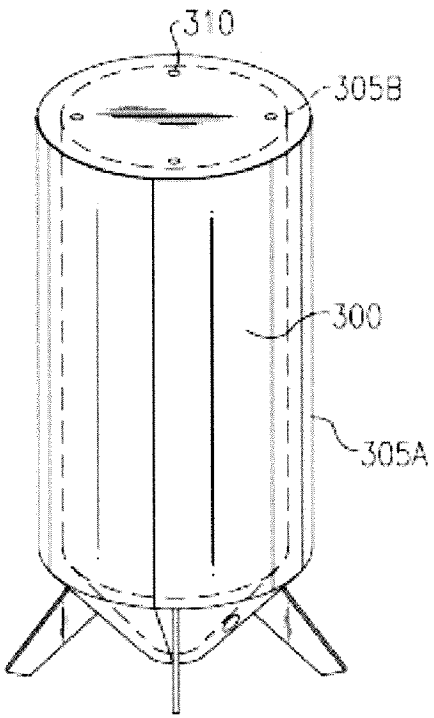

FIGS. 3A-3C illustrate three implementations that may be utilized to configure the silo's facade for interior home embodiments of the invention. Depending on the embodiment, a facade cover/shell 305 may be formed from a cloth material, a type of plastic or any other number of materials.

By way of example only, FIGS. 3A and 3B illustrate implementations of an storage unit facade cover for storage unit 300. In the implementation illustrated in FIG. 3A, the primary facade cover 305A wraps around the circumference of the storage chamber, while extending the length of the vertical axis. If the top cover 305B of the storage container is pivotally attached a separate cap portion 305B is provided within the facade cover. Furthermore, the top portion of the storage unit 300 is configured with attachment points 310 for attaching both the primary cover 305A and the cap portion 305B of the facade cover. It is to be understood that the attachment points 310 may be formed as any number of binding elements, such as snaps, buttons or zippers to secure the facade cover to the storage chamber. Attachment points 310 may also be formed along the bottom portion of the silo storage unit to further secure the facade cover to the storage unit 300.

In FIG. 3B, the top portion of the storage unit 300 is formed integral with the vertical cylinder. However, the top portion of storage unit 300 includes an attachment aperture 315 configured for joining with an attachment hose (not illustrated). Accordingly, the facade cover 320 may be configured formed as a single unit. As in FIG. 3A, in order to secure the facade cover 320 to the storage unit 300, both the storage unit 300 and the facade cover 320 are formed with attachment points 310. Further, the facade cover is formed with an attachment flap 325 that is opened to provide access to the attachment aperture 315. As illustrated in FIG. 3B, the cover includes snaps 310 on the top end of the cover and a drawstring 330 or attachment points (as in FIG. 3A) on the bottom portion of the facade cover to assist in securing the facade cover 320 to the storage unit 300.

FIG. 3C illustrates a first exterior implementation wherein the facade cover is formed with a woodland print coating (or camouflage) 335 to make the storage unit 300 look non-intrusive for outdoor implementations. In FIG. 3C, the facade cover is also configured to hold artificial branches 340 and leaves (non-illustrated) to assist in disguising the storage silo 300 as an evergreen tree. It is to be understood that the facade cover 320 may be used to create the appearance of a shrub, bush, an evergreen or a small tree, however these are simply illustrative non-limiting examples of possible facade cover configurations.

Figure 4A:
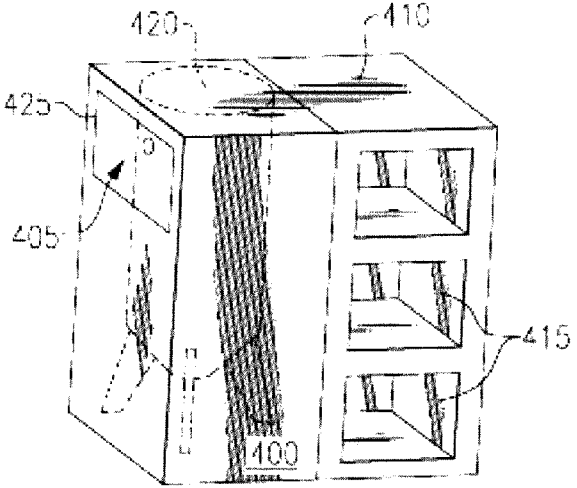
FIGS. 4A-4E illustrate embodiments of the invention that are situated along the exterior of a home or other structure.

FIGS. 4A-4E illustrate examples of several interior silo storage unit implementations. In contrast to the outdoor facade cover 320 illustrated in FIG. 3C, the external appearance of the interior storage silo 400 may be configured by simulating home furnishings or creating a facade that presents faux wall, closet or other housing element. By way of example only, FIG. 4A illustrates a storage silo that is formed as part of a book case 400. Accordingly, the unit 400 is formed with a hollow side portion 405 and a utility portion 410 configured with storage shelves 415.

Depending on the implementation, the front of the hollow portion may be formed with decorative woodwork or some other type of ornamentation. Alternately, the hollow portion may be situated behind the utility portion 410—creating long shelves that do not extend as deep into the unit 400 as they do in the illustrated implementation. Regardless, it is necessary to include an access panel 425 so that storage unit may be accessed and filled with storage material.

Figure 4B:
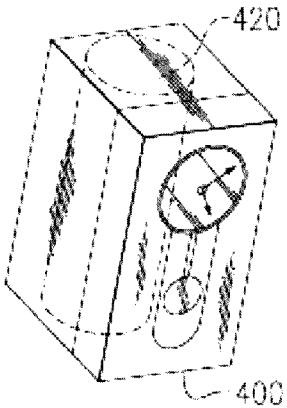

Further, it is to be understood that the bookcase embodiment may be configured as a number of different heights and widths based on the amount of available space and the owner's storage needs. Also, it is to be understood that the shape of the storage chamber within the unit may be modified from the embodiment illustrated in FIGS. 2 and 3 to maximize storage capacity within the unit 400. In FIG. 4B, the unit 400 is illustrated as a home entertainment center.

FIG. 4B illustrates a grandfather clock implementation of the silo storage unit. More specifically, the storage unit 420 is situated in the cabinet behind the clock mechanism. Alternately, the storage unit may be formed as a furniture element that resembles a dresser, an armoire, or other piece of furniture. In these embodiments, the unit is not necessarily formed with the additional storage capabilities as the implementations illustrated in FIG. 4A.

Figure 4C:
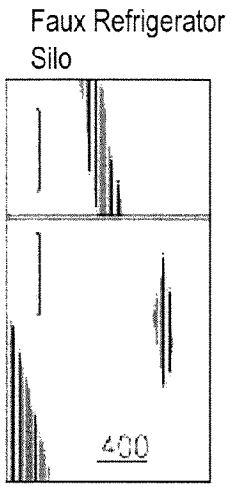
Figure 4D:
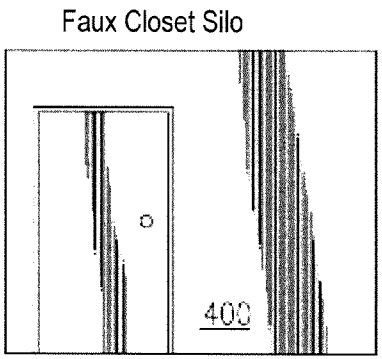
Figure 4E:
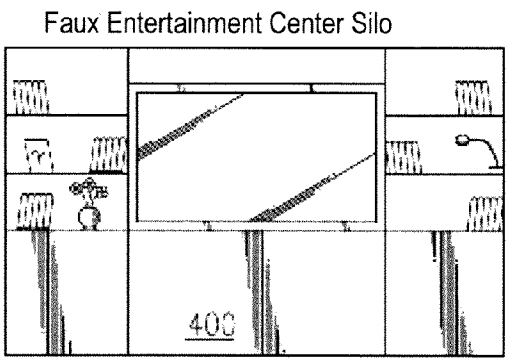

In an alternate embodiment illustrated in FIG. 4C, the storage silo may be formed as a unit that resembles a closet and a closet door. However, such implementations are simply representation facades (images) that are attached to the front of the storage unit 400. In some implementations, the faux closet unit in FIG. 4C may be recessed into an interior wall of a house. Alternately, faux implementations may be formed as a faux refrigerator as in FIG. 4D, as faux entertainment center as in FIG. 4E, a faux room, faux wall, faux window, faux dormer, faux chimney, or any other number of housing element representations. Furthermore, it is to be understood that any of the faux implementations may be modified to include utility portions like those discussed with regard to FIGS. 4A and 4B.

FIGS. 5A-5G illustrate outdoor storage silo facade cover implementations. By way of example only, the facade cover may be formed from a cloth material as described above with regard to FIG. 3C. The facade covers illustrated in these figures may also incorporate wire frames or other support elements disposed within the cloth cover to provide additional structure and support for the various facade cover implementations.

Figure 5A:
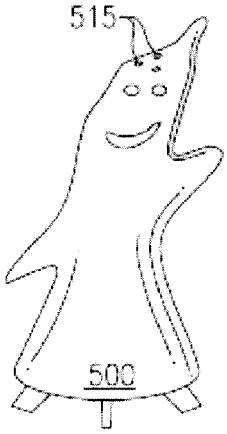
FIGS. 5A-5G illustrate temporary silo structures that are configured for exterior implementations.
Figure 5B:
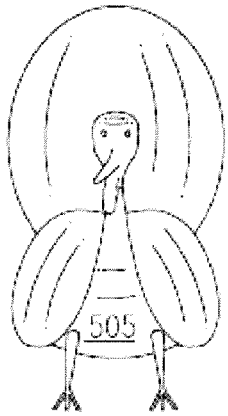
Figure 5C:
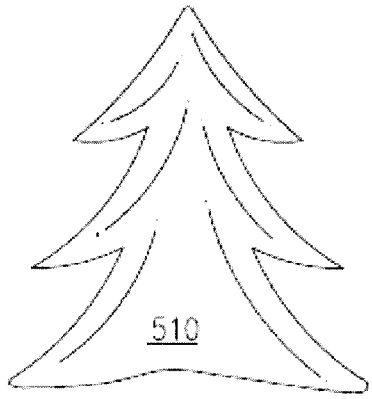

FIGS. 5A-5C illustrate a series of holiday facade implementations. By way of example only, FIG. 5A illustrates a Halloween facade cover 500 implementation; FIG. 5B illustrates a Thanksgiving facade cover 505 implementation; FIG. 5C a Christmas facade cover 510 implementation. It is to be understood that the facade covers may be configured so that a owner can easily interchange them as the seasons progress. Also, as illustrated in FIGS. 3A-3C, each of the storage units and facade covers are configured with attachment points 515. Further, additional implementations may be created for other holidays such as Valentine's Day, St. Patrick's Day, Easter, Independence Day or any other number of holidays.

Figure 5D:
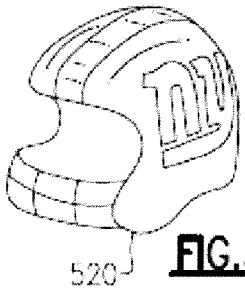
Figure 5E:
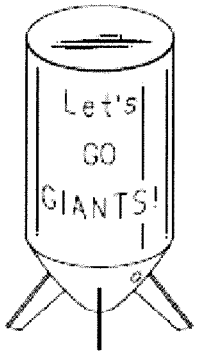
Figure 5F:
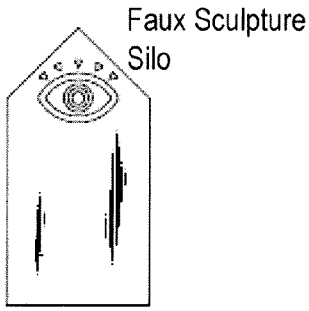
Figure 5G:
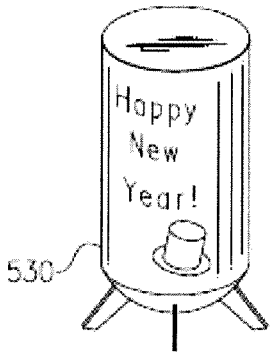

FIGS. 5D-5E are facade cover implementations 520 and 525 directed to sport fan silo owners. By way of example only the cloth or shell facade may be configured as a sporting element, such as a football helmet in FIG. 5D, a baseball hat with a team insignia, or a customized motivational message as shown in FIG. 5E. FIG. 5F illustrates a facade cover 530 that combines the holiday theme with a customizable message. In an additional implementation illustrated in FIG. 5G, a shell facade cover 535 is configured as a sculpture (shown as an Egyptian implementation) or work of art. In alternate implementations, the shell facade may be configured as a lawn ornament.

Figure 6A:
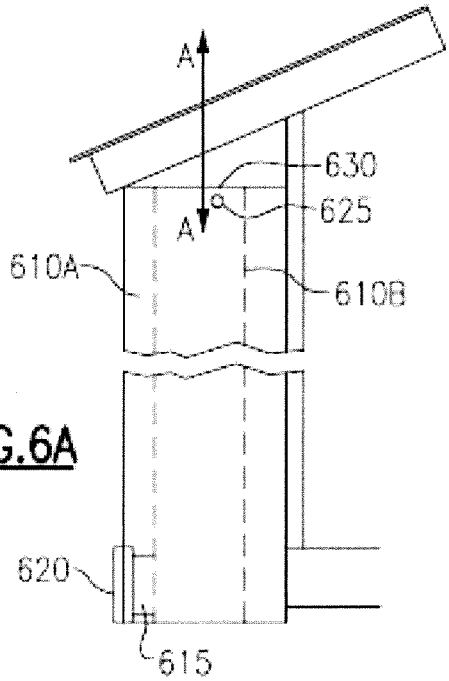
FIGS. 6A and 6B illustrate an exterior storage unit according to an embodiment of the invention.
Figure 6B:
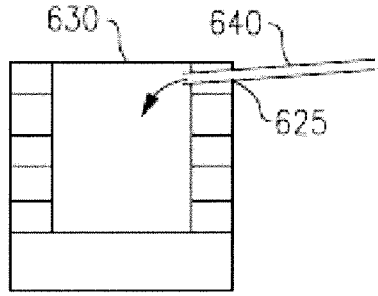

FIGS. 6A and 6B illustrate cross-sections of a housing element implementation. As illustrated in FIG. 6A, the storage unit 600 is formed adjacent to an existing wall 605. The interior of the storage chamber 610A is lined with a plastic liner 610B. A bottom portion of the storage unit 600 is configured with an outlet 615 and corresponding access panel 620. The top of storage unit 600 includes a plastic inlet aperture 625 and plastic access panel 630. FIG. 6B illustrates a cross-section taken along line A-A in FIG. 6A. More specifically, FIG. 6B illustrates filling of the storage chamber 610A, by feeding a delivery chute/tube 640 through inlet aperture 625.

Figure 7A:
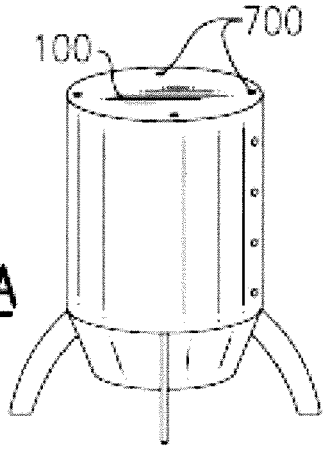
FIGS. 7A-7C illustrate an embodiment, wherein standardized storage containers are adapted according to an implementation of the present invention.
Figure 7B:
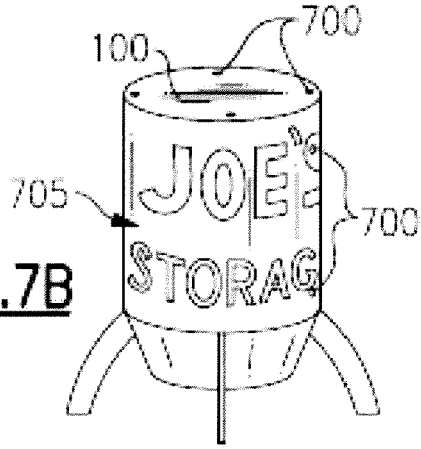
Figure 7C:
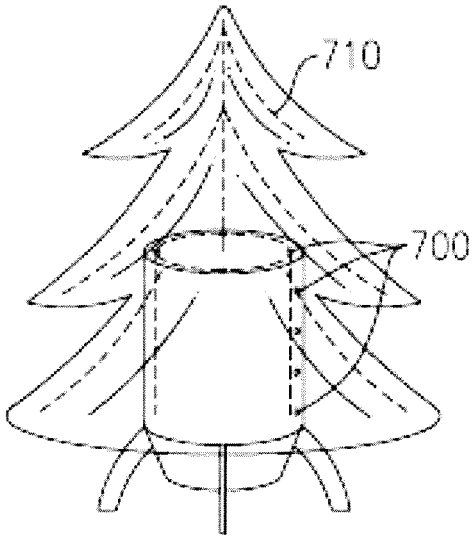

FIGS. 7A-7C illustrate an embodiment directed to adapting standard storage containers according to the invention. For the purposes of illustration, the embodiments illustrated in FIGS. 7A-7C are similar to the storage containers illustrated in FIG. 1A. As a first step, a standard storage container 100 illustrated in FIG. 7A may be fitted with several attachment points 700. As discussed above, the attachment points 700 may be formed as Velcro tabs, snap/button elements or any other number of securing mechanisms. Once the storage container is configured with attachment points, a container cover 705 is secured to the container at attachment points 700. It is to be understood that depending on the implementation the container cover may be tailored to fit a wide variety of standard storage containers.

Further, the container cover 705 may also be customized for a particular implementation. For example the various implementations illustrated in FIGS. 5A-5G that include decorative, functional, indoor and/or outdoor implementations. For example, in one implementation the container cover is configured as a fabric or plastic material and conforms to the exterior shape of storage container. FIG. 7B illustrates a container cover 705 configured with a corporate advertisement for "Joes' Storage" formed from a weather-resistant material for an outdoor storage implementation. In an alternate embodiment, instead of securing the container cover 705 directly to the container, FIG. 7C illustrates a support structure 710 that is secured to the storage container at the attachment points 700 and the fabric/plastic material is selected to conform to the contour of the support structure. Although the support structure is configured in FIG. 7C as a decorative implementation (e.g., a christmas tree), the support structure and corresponding cover may include any number of alternate implementations or configurations.

FIG. 7C illustrates an alternate embodiment of the invention. In FIG. 7C, the container cover is configured for an outdoor implementation. Accordingly, the container cover may be formed from any type of weather resistant material, such as plastic. Specifically, in FIG. 7C the container cover is formed as a hardened plastic shell, which can be further customized for a wide variety of applications, including: decorative lawn furniture, natural elements such as rocks, bushes, or trees, or any other possible implementations.

Figure 8:
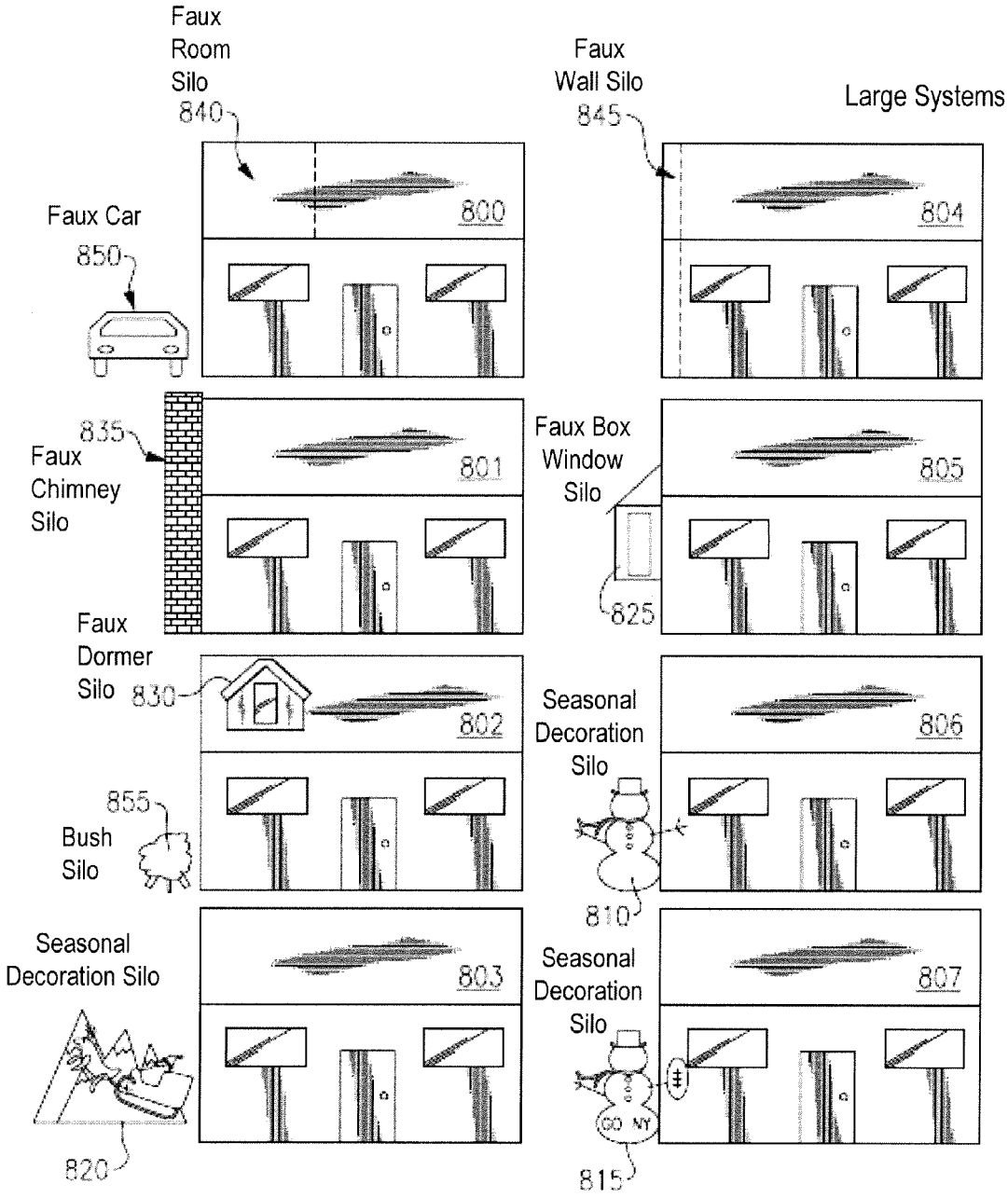
FIG. 8 illustrates a series of embodiments of the invention including decorative, transparent and standardized implementations.

FIG. 8 provides a high-level diagram of possible storage unit implementations according to the invention within a neighborhood of homes 800-807. By way of non-limiting example only, FIG. 8 illustrates decorative storage silos (810,

815 and 820); housing element storage silos (825, 830, 835, 840 and 845); as well as a non-intrusive storage silo (850 and 855).

The entirety of this disclosure (including the Cover Page, Title, Headings, Field, Background, Summary, Brief Description of the Drawings, Detailed Description, Claims, Abstract, Figures, and otherwise) shows by way of illustration various embodiments in which the claimed inventions may be practiced. The advantages and features of the disclosure are of a representative sample of embodiments only, and are not exhaustive and/or exclusive. They are presented only to assist in understanding and teach the claimed principles. It should be understood that they are not representative of all claimed inventions. As such, certain aspects of the disclosure have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and functional, structural and/or configuration modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. Some features are applicable to one aspect of the invention, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, functional, features, configurations, and/or other aspects of the disclosure are not to be considered limitations on the disclosure as defined by the claims or limitations on equivalents to the claims.

I claim:

1. A high-energy solid fuel element storage unit for storing high energy solid fuel elements comprising:

a high-energy solid fuel element storage chamber incorporating a primary storage area;

an at least one inlet aperture formed in a surface of the high-energy solid fuel element storage unit operatively in communication with a gravity-fed solid fuel element input chute that facilitates gravity-fed solid fuel element input of the primary storage area;

an at least one outlet aperture formed in the surface of the high-energy solid fuel element storage unit formed with a gravity distribution element;

a high-energy solid fuel element storage unit facade engaged with the high-energy solid fuel element storage unit wherein an interior of the storage unit facade corresponds with solid fuel element input and output apertures and does not impede storage unit input/dispensing activity despite facade engagement through corresponding high-energy solid fuel element storage unit facade pellet inlet and facade pellet output apertures incorporated with the fuel storage unit facade;

wherein the high-energy solid fuel element storage unit facade is formed with at least two independent securing elements configured as (1) a mechanical attachment element, and (2) a drawstring attachment element that secure the facade to the high-energy solid fuel element storage unit, the high-energy solid fuel element storage chamber is formed with a corresponding mechanical attachment element that engages with the high-energy solid fuel element fuel storage unit facade's mechanical attachment element; and, wherein the high-energy solid fuel element storage unit facade incorporates support elements for vegetative material.

2. The high-energy solid fuel element storage unit of claim 1, wherein the primary storage area is non-cylindrical.

3. The high-energy solid fuel element storage unit of claim 1, wherein the high-energy solid fuel element storage unit is configured with pest control elements.

4. The high-energy solid fuel element storage unit of claim 1, wherein the high-energy solid fuel element storage unit is configured with environment control elements.

5. The high-energy solid fuel element storage unit of claim 1, wherein the high-energy solid fuel element storage unit is a temporary installation.

6. The high-energy solid fuel element storage unit of claim 1, wherein the primary storage area is cylindrical.

7. The high-energy solid fuel element storage unit of claim 1, wherein the high-energy solid fuel element storage unit facade incorporates support elements to support artificial tree branch elements.

8. The high-energy solid fuel element storage unit of claim 1, wherein the high-energy solid fuel element storage unit facade comprises a decorative print formed as an house-external non-intrusive implementation.

9. The high-energy solid fuel element storage unit of claim 1, wherein the high-energy solid fuel element storage unit facade comprises a decorative print formed as an internal housing element implementation.

10. The high-energy solid fuel element storage unit of claim 9, wherein the internal housing element implementation also incorporates shelving elements.

11. The high-energy solid fuel element storage unit of claim 9, wherein the internal housing element implementation incorporates a representation of a housing element.

* * * * *